US006053319A

United States Patent [19]

Smith

[11] Patent Number: 6,053,319

[45] Date of Patent: Apr. 25, 2000

[54] PACKAGING CARD FOR A DEVICE, SUCH AS A PEN REFILL, AS WELL AS A METHOD FOR PACKAGING SUCH A DEVICE

[75] Inventor: Paul A. Smith, Glenview, Ill.

[73] Assignee: Eversharp Pen Co.

[21] Appl. No.: 09/295,725

[22] Filed: Apr. 21, 1999

[51] Int. Cl.[7] ..... B65D 73/00

[52] U.S. Cl. ..... 206/461; 206/468; 206/459.1

[58] Field of Search ..... 206/232, 459.1, 206/461, 468, 469, 467; 229/70

[56] References Cited

U.S. PATENT DOCUMENTS

| | | | |
|---|---|---|---|
| 2,033,998 | 3/1936 | Prager . | |
| 3,770,120 | 11/1973 | Hanson . | |
| 4,132,348 | 1/1979 | Bromberg . | |
| 4,192,422 | 3/1980 | Kotyuk | 206/468 |
| 4,234,079 | 11/1980 | Otake | 206/459.1 |
| 4,413,730 | 11/1983 | Morse | 206/232 |
| 4,585,123 | 4/1986 | Penry | 206/459.1 |
| 4,953,700 | 9/1990 | DeDino | 206/333 |
| 5,186,499 | 2/1993 | Mason | 206/461 |

*Primary Examiner*—David T. Fidei
*Attorney, Agent, or Firm*—Patents & TMS, P.C.

[57] ABSTRACT

A packaging card holding a device, such as a refill for a pen, and a method for packaging such a device are provided. The card has a front panel, a center panel and a back panel. The center panel may be transposed with respect to the front panel and the back panel. The center panel includes information related to the device on the card. The center panel may be rotatable or may be transposed parallel to or perpendicular to lengths of the front panel and the back panel. Preferably, each of the front panel and the back panel have an aligned aperture for suspending the card from, for example, a display hook.

21 Claims, 2 Drawing Sheets

PACKAGING CARD FOR A DEVICE, SUCH AS A PEN REFILL, AS WELL AS A METHOD FOR PACKAGING SUCH A DEVICE

BACKGROUND OF THE INVENTION

The present invention generally relates to a packaging card. More specifically, the present invention relates to a packaging card for a device such as a refill for a pen as well as a method for packaging such a device for display and merchandising thereof.

It is, of course, generally known to provide a refill for a writing instrument, such as a pen. Pens are traditionally manufactured and sold with a cartridge containing ink. Generally, the cartridge is replaceable. Such a cartridge is generally known in the industry as a "refill." However, various manufacturers of pens require various types and sizes of refills to fit their pens.

Accordingly, it is often difficult for a consumer to determine the type of refill to purchase that fits a specific pen. Also, any given refill may fit many types of pens produced by various manufacturers. This requires printing of a significant amount of information on, for example, the packaging of the refill. Additional printing on the package itself often makes the package cluttered and difficult to read. Also, excessive printed information may require the packaging to be larger than is necessary to package and display the device intended to be merchandised.

Accordingly, a need, therefore, exists for an improved packaging card for a device such as a refill for a pen, as well as a method for packaging and merchandising such a device.

SUMMARY OF THE INVENTION

The present invention provides a packaging card for a device, such as, for example, a refill for a pen. The card is interactive to a consumer considering purchase of the device. Additional information associated with the card may be provided without substantially increasing the size of the card. In addition, a method for packaging a device, such as a pen refill, for display and merchandising thereof is also provided.

To this end, in an embodiment of the present invention, a packaging card is provided for a device. The card has a front panel that has a front side and a back side wherein the device is disposed on the front side of the front panel. A back panel has a front side and a back side. A center panel is provided between the front panel and the back panel wherein the center panel is transposable to various positions. An adhesive connects the back side of the front panel to the front side of the back panel. Information printed on the center panel relates to the device disposed on the front panel.

In an embodiment, an aperture is provided through each of the front panel and the back panel wherein the apertures are aligned.

In an embodiment, the center panel is circular and substantially rectangular.

In an embodiment, an eyelet is secured through the front panel, the back panel and the center panel wherein the center panel is rotatable on the eyelet.

In an embodiment, the center panel is substantially rectangular with a protruding ear at one end of the center panel.

In an embodiment, an aperture is provided through the front panel wherein the information on the center panel aligns with the aperture through the front panel.

In an embodiment, an aperture is provided through the back panel wherein the information on the center panel aligns with the aperture through the back panel.

In an embodiment, an aperture is provided through the center panel.

In an embodiment, the front panel and the back panel are substantially equally sized and integrally formed.

In another embodiment of the present invention, a method is provided for packaging a device on a card. The method comprises the steps of: providing a front panel and a back panel; securing the front panel to the back panel; disposing the device on the front panel; and providing a center panel with information printed thereon associated with the device wherein the center panel is transposed with respect to the front panel and the back panel.

In an embodiment, a window is provided in the front panel through which the information is displayed. The center panel may be rotated to view the information in the window.

In an embodiment, an aperture is provided in each of the front panel and the back panel wherein the apertures are aligned.

In an embodiment, an aperture is provided in the center panel wherein the aperture in the center panel is alignable with the apertures in the front panel and the back panel.

In an embodiment, the information may be color coded on the center panel.

In an embodiment, a window is provided through the back panel of the card through which the information on the center panel is displayed.

In an embodiment, the front panel and the back panel are integrally formed.

In an embodiment, the center panel may slide in a direction substantially perpendicular to lengths of the front panel and the back panel.

In an embodiment, the center panel may slide in a direction substantially parallel to lengths of the front panel and the back panel.

It is, therefore, an advantage of the present invention to provide a packaging card for a device as well as a method for packaging a device on a card that provide additional information without increasing the size of the packaging.

Yet another advantage of the present invention is to provide a packaging card and a method for packaging a device on a card that is interactive for a consumer considering purchase of the device associated with the packaging card.

A still further advantage of the present invention is to provide a packaging card for a device as well as a method for packaging a device on a card that is simple to manufacture.

Yet another advantage of the present invention is to provide a packaging card and a method for packaging a device on a card that interactively provides additional information without requiring additional space for display and merchandising of the device.

Additional features and advantages of the present invention are described in, and will be apparent from, the detailed description of the presently preferred embodiments and from the drawings.

DETAILED DESCRIPTION OF THE PRESENTLY PREFERRED EMBODIMENTS

The present invention generally relates to a packaging card. More specifically, the present invention relates to a packaging card for a device, such as a refill for a pen, as well as a method for packaging such a device, particularly for merchandising and display.

Figure 1:
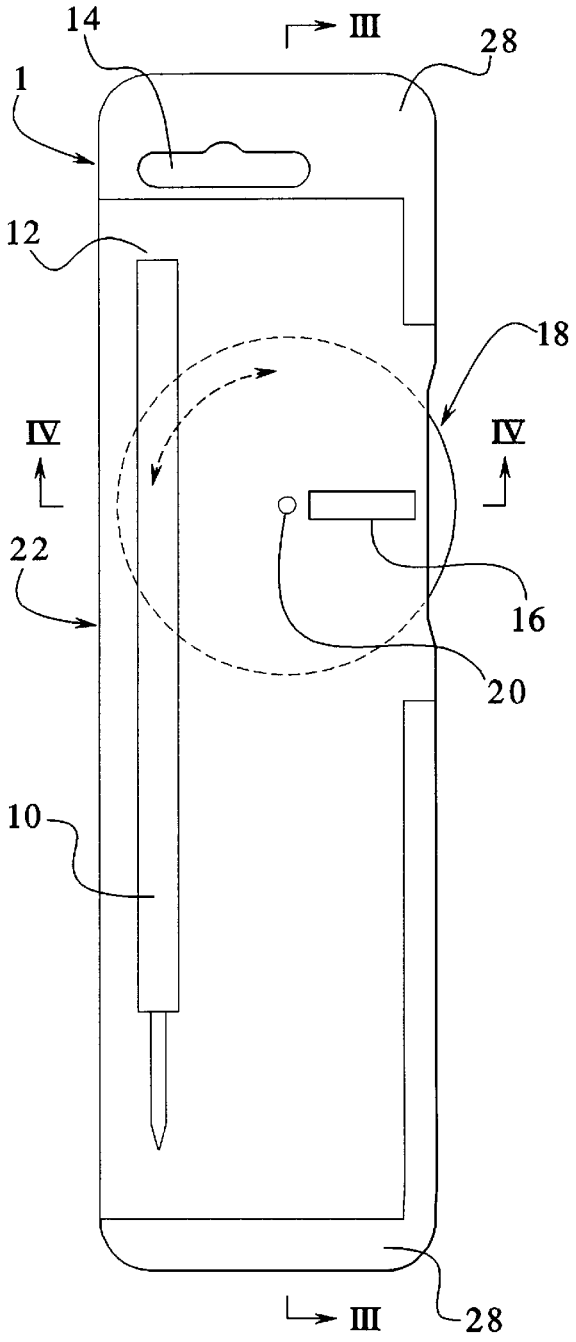
FIG. 1 illustrates a front plan view of an embodiment of a packaging card of the present invention.

Referring now to the drawings wherein like numerals refer to like parts, FIG. 1 generally illustrates a display card 1 on which a refill 10 for, for example, a pen may be attached. The refill 10 may be secured to a front face 12 of the display card 1 in a known manner. As is conventional in the packaging of such refills, the refill 10 is generally placed within a plastic layer (not shown) such that the refill 10 "floats" between the plastic layer and the front face 12 of the display card 1. This is generally known as a "blister card." Of course, the refill 10 may be attached to the display card 1 in other known manners well-known to those skilled in the art, and the attachment of the refill 10 to the display card 1 is not critical to the present invention.

As illustrated, the front face 12 of the display card 1 includes an aperture 14 that extends through the front face 12. The aperture 14 is generally used to suspend the display card 1 from, for example, a hook for merchandising and display thereof.

The front face 12 has a window 16 through which information printed on a rotatable wheel 18 may be displayed. The wheel 18 rotates on an axis formed at an eyelet 20. On the wheel 18, preferably, is information relating to the refill 10 mounted to the front face 12 of the display card 1. The information may, for example, relate to the types or manufacturers of pens for which the refill 10 may be implemented. Of course, other information may also be printed on the wheel 18 and displayed through the window 16 upon rotation of the wheel 18. The wheel 18 may, of course, rotate in either a clockwise or counter-clockwise direction as effected by a user.

Figure 2:
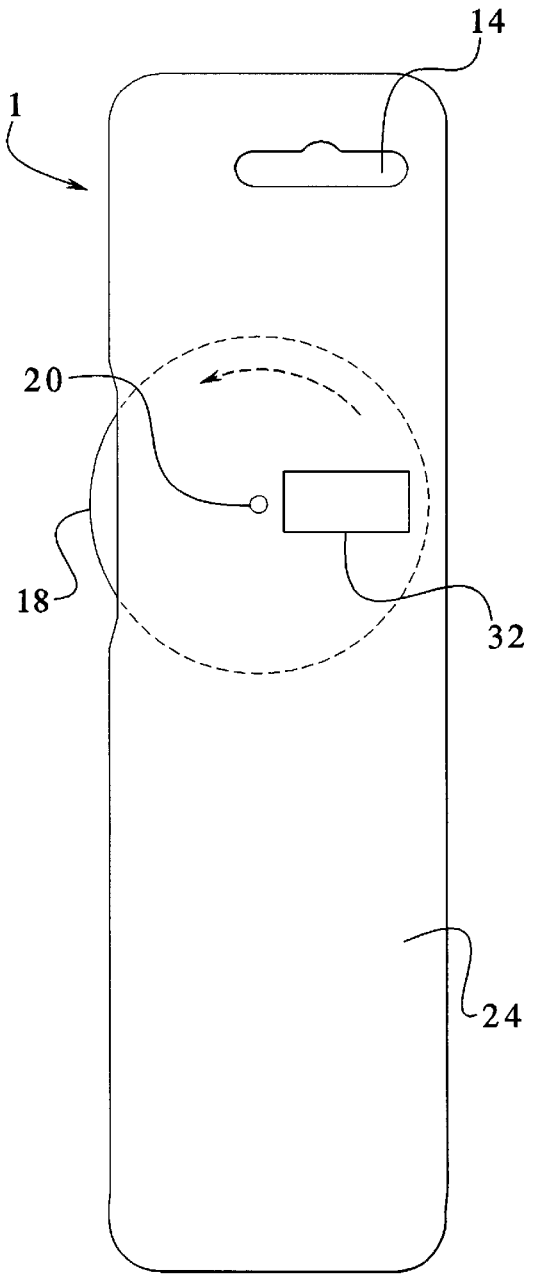
FIG. 2 illustrates a back plan view of an embodiment of a packaging card of the present invention.
Figure 3:
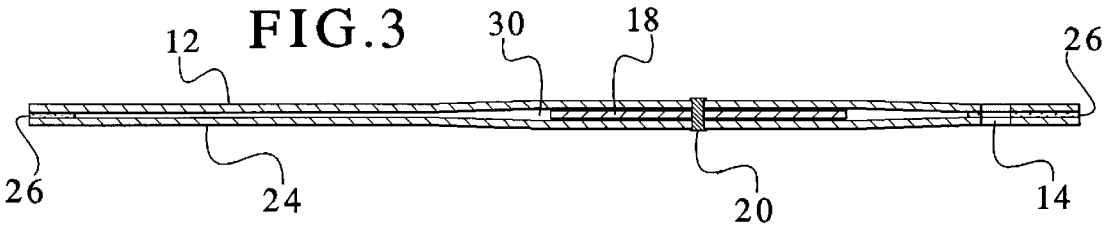
FIG. 3 illustrates a cross-sectional view of the packaging card taken generally along the line III—III of FIG. 1.
Figure 4:
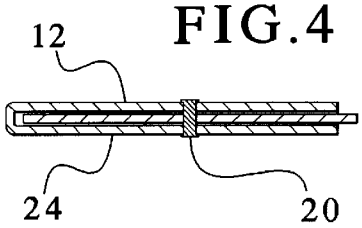
FIG. 4 illustrates a cross-sectional view of the packaging card taken generally along the line IV—IV of FIG. 1.

Preferably, the display card 1 is constructed of a single layer of material that is folded along one end 22. A back face 24 of the display card 1 is shown in FIG. 2. Preferably, the front face 12 and the back face 24 are secured by an adhesive 26 in areas 28 generally designated by the dashed lines in FIG. 1 and also shown in further detail in FIG. 3. After the display card 1 is folded at the end 22 and the adhesive 26 secures at the areas 28 as shown, a pocket 30 is created in which the wheel 18 may be caused to rotate about the eyelet 20 as effected by a user, such as a consumer.

On the back face 24 of the display card 1 is another window 32 through which information printed on the wheel 18 may be displayed. The information within the window 32 is preferably the same information that appears in the window 16 on the front face 12 as the wheel 18 rotates about the axis of the eyelet 20. As a result, a consumer purchasing a product, such as the refill 10 merchandised on the display card 1, may remove the display card 1 from, for example, a merchandising hook extending through the aperture 14 of the display card 1 and rotate the wheel 18 to obtain additional information regarding use of the refill 10. For example, the information that may be displayed through the window 16 and/or 32 may relate to the types of pens for which the refill 10 may be used. More specifically, a specific type of pen manufactured by a specific manufacturer may be provided as information on the card 18 for display in the window 16 and/or the window 32.

Although the display card 1 is illustrated as a single piece of material integrally formed and folded as shown in FIGS. 1–4, it should be appreciated that the display card 1 may be formed of more than one sheet of material adhered as required such that the pocket 30 is formed in which the wheel 18 may be rotated.

Figure 5:
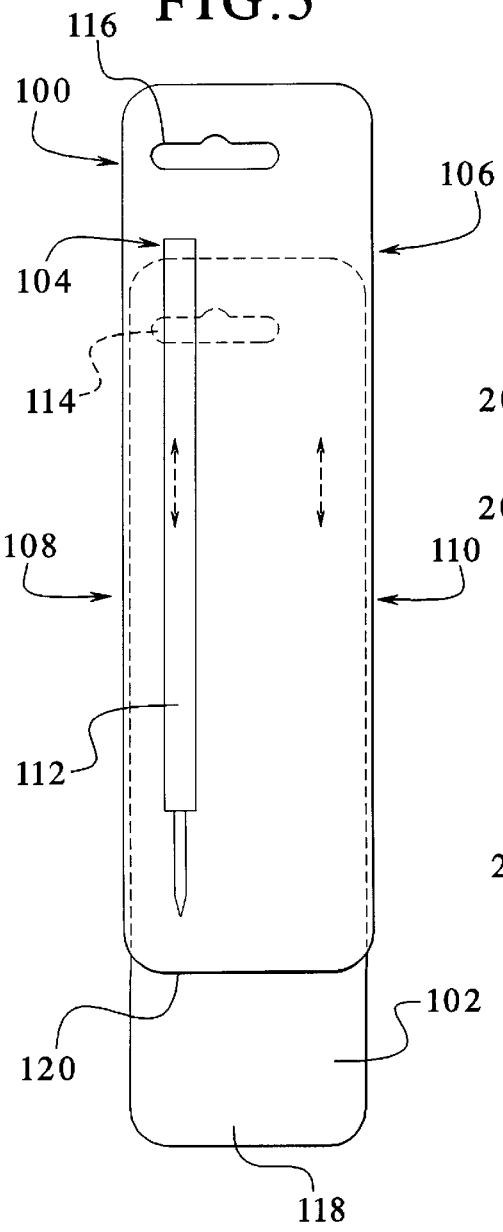
FIG. 5 illustrates a plan view of an alternate embodiment of a packaging card of the present invention.
Figure 6:
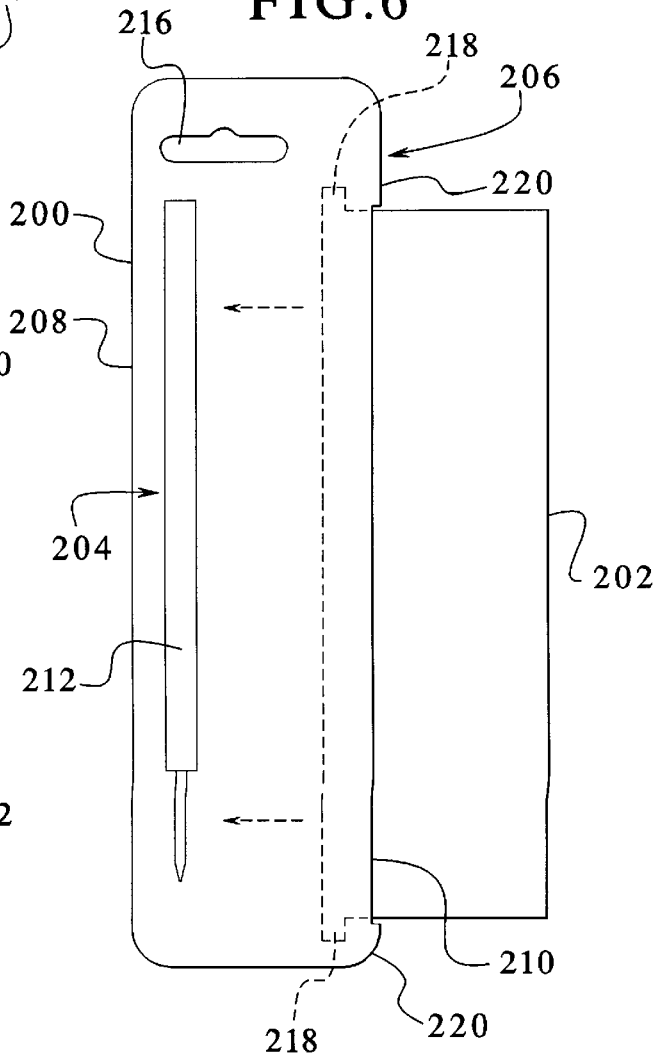
FIG. 6 illustrates a plan view of yet another embodiment of a packaging card of the present invention.

FIGS. 5 and 6 illustrate alternate embodiments of a display card of the present invention. As illustrated in FIG. 5, a display card 100 is shown having a sliding card 102 formed intermediate a front face 104 and a back face 106. Preferably, the front face 104 is integrally formed with the back face 106 and folded at one side 108 of the display card 100. Along the edge of the opposite side 110 of the display card 100 is an adhesive (not shown). The adhesive may be incorporated to secure the front face 104 to the back face 106 and provide a pocket in the interior of the display card between the front face 104 and the back face 106 in which the sliding card 102 may vertically translate along the length of the display card 100 as generally illustrated in FIG. 5.

The sliding card 102 may be printed with information related to a product, such as a refill 112, mounted or otherwise secured to the front face 104 of the display card 100 in a manner generally known in the art, such as that previously described with reference to FIG. 1. The information printed on the sliding card 102 may relate to, for example, the types of pens or manufacturers of pens for which the refill 112 is intended.

The display card 100 may have an aperture 114 corresponding to the aperture 116 through the front face 104 and the back face 106 of the display card 100. When the display card 100 is suspended from, for example, a hook in a merchandising display, the hook extends through the aperture 114 and the aperture 116 to maintain the sliding card 102 in a fixed position and substantially hidden within the pocket of the display card 100. Preferably, a portion of an end 118 of the sliding card 102 extends from an end 120 of the display card 100 to alert, for example, a consumer that the sliding card 102 may be withdrawn from the display card 100.

Referring now to FIG. 6, another embodiment of a display card 200 is shown having a sliding card 202 within a pocket formed between a front face 204 and a back face 206. The front face 204 and the back face 206 may be folded at one side 208 and adhered around a periphery of the display card 200 except for an opposite side 210 through which the sliding card 202 extends. A refill 212 may be mounted or otherwise attached to the front face 204 of the display card 200 in a known fashion such as the manner shown and described with reference to FIG. 1. An aperture 216 may further be provided through which a hook or the like may extend for merchandising display of the display card 200 with the refill 212 or other device mounted on the display card 200.

The sliding card 202 includes ears 218 at opposite ends of the sliding card 202 as illustrated in FIG. 6. The ears 218 prevent the sliding card 202 from being removed from the pocket created between the front face 204 and the back face 206 when the sliding card 202 is pulled to the right in the position generally illustrated in FIG. 6. The ears 218 create interference with the adhered corners 220 of the display card 200 preventing the display card 202 from removal from a remainder of the display card 200. The sliding card 202 may include information printed thereon related to the device, such as the refill 212 attached thereto or otherwise associated with the display card 200. The information may relate to, for example, the types of pens and/or manufacturers for which the refill 212 may be implemented. The information may also be color coded in various manners to simplify legibility of the information on the sliding card 202 as well as to provide a visually enticing sliding card 202 that extends from a pocket of the display card 200 at the side 210. The color coding may correspond to, for example, a different color for each of the manufacturers of pens in which the refill 212 mounted on the display card 200 may be implemented.

Although the display card of FIGS. 1–6 has been shown and described with reference to display of, for example, a refill for a pen, it should be understood and appreciated that many uses and displays of products, particularly for merchandising, may be implemented and use an embodiment of the display card of the present invention with its incorporated window, rotatable wheel and/or sliding card having information printed thereon. The information advantageously provides a manner in which additional information may be provided and yet maintain and implement a relatively small and uncomplicated card for merchandising display of products.

It should be understood that various changes and modifications to the presently preferred embodiments described herein will be apparent to those skilled in the art. Such changes and modifications may be made without departing from the spirit and scope of the present invention and without diminishing its attendant advantages. It is, therefore, intended that such changes and modifications be covered by the appended claims.

I claim:

1. A packaging card for a device, the card comprising:

a front panel having a front side and a back side wherein the front panel has a perimeter defined by a top, a bottom, a left side and a right side wherein the device is positioned within the perimeter;

a back panel having a front side and a back side;

a center panel between the front panel and the back panel wherein the center is transposable to various positions;

an adhesive connecting the back side of the front panel to the front side of the back panel; and information printed on the center panel relating to the device disposed on the front panel.

2. The card of claim 1 further comprising:

an aperture through each of the front panel and the back panel wherein the apertures are aligned.

3. The card of claim 1 wherein the center panel is circular.

4. The card of claim 1 wherein the center panel is substantially rectangular.

5. The card of claim 1 further comprising:

an eyelet secured through the front panel, the back panel and the center panel wherein the center panel is rotatable on the eyelet.

6. The card of claim 1 wherein the center panel is substantially rectangular with a protruding ear at one end of the center panel.

7. The card of claim 1 further comprising:

an aperture through the front panel wherein the information on the center panel aligns with the aperture through the front panel.

8. The card of claim 1 further comprising:

an aperture through the back panel wherein the information on the center panel aligns with the aperture through the back panel.

9. The card of claim 1 further comprising:

an aperture through the center panel.

10. The card of claim 1 wherein the front panel and the back panel are substantially equally sized.

11. The card of claim 1 wherein the front panel and the back panel are integrally formed.

12. A method for packaging a device on a card, the method comprising the steps of:

providing a front panel and a back panel wherein the front panel has a perimeter defined by a top, a bottom, a left side and a right side;

securing the front panel to the back panel;

positioning the device within the perimeter on the front panel; and providing a center panel with information printed thereon associated with the device wherein the center panel is transposed with respect to the front panel and the back panel.

13. The method of claim 12 further comprising the steps of:

providing a window in the front panel through which the information is displayed; and rotating the center panel to view the information in the window.

14. The method of claim 12 further comprising the step of:

providing an aperture in each of the front panel and the back panel wherein the apertures are aligned.

15. The method of claim 14 further comprising the step of:

providing an aperture in the center panel wherein the aperture in the center panel is alignable with the apertures in the front panel and the back panel.

16. The method of claim 12 further comprising the step of:

color coding the information on the center panel.

17. The method of claim 12 further comprising the step of:

providing a window through the back panel of the card through which the information on the center panel is displayed.

18. The method of claim 12 wherein the front panel and the back panel are integrally formed.

19. The method of claim 12 further comprising the step of:

sliding the center panel in a direction substantially perpendicular to lengths of the front panel and the back panel.

20. The method of claim 12 further comprising the step of:

sliding the center panel in a direction substantially parallel to lengths of the front panel and the back panel.

21. A packaging card for a device, the card comprising:

a front panel having a front side and a back side wherein the device is disposed on the front side of the front panel;

a back panel having a front side and a back side;

a center panel between the front panel and the back panel wherein the center panel is transposable to various positions and further wherein the center panel is substantially rectangular with a protruding ear at one end of the center panel;

an adhesive connecting the back side of the front panel to the front side of the back panel; and information printed on the center panel relating to the device disposed on the center panel.

* * * * *